US006327723B1

(12) United States Patent
Knight

(10) Patent No.: US 6,327,723 B1
(45) Date of Patent: Dec. 11, 2001

(54) BACKBOARD HEAD STABILIZER

(76) Inventor: Keith Knight, P.O. Box 16445, Plantation, FL (US) 33318

( * ) Notice: Subject to any disclaimer, the term of this patent is extended or adjusted under 35 U.S.C. 154(b) by 0 days.

(21) Appl. No.: 09/692,375

(22) Filed: Oct. 20, 2000

(51) Int. Cl.[7] ..... A61G 1/04
(52) U.S. Cl. ..... 5/628; 5/627; 5/637; 128/870
(58) Field of Search ..... 128/869, 870, 128/876; 5/630, 634, 637, 625, 626, 627, 621, 622, 628

(56) References Cited

U.S. PATENT DOCUMENTS

| | | | | |
|---|---|---|---|---|
| 2,675,564 | * | 4/1954 | Hughes | 5/628 |
| 3,653,079 | | 4/1972 | Bourgraf et al. | 5/82 |
| 3,707,734 | | 1/1973 | Matthews | 5/82 |
| 3,737,923 | * | 6/1973 | Prolo | 5/628 |
| 3,775,782 | | 12/1973 | Rice et al. | 5/82 |
| 4,033,000 | | 7/1977 | Bonifay | 5/82 R |
| 4,124,908 | | 11/1978 | Burns et al. | 5/82 R |
| 4,369,982 | | 1/1983 | Hein et al. | 280/47.13 R |
| 4,480,345 | | 11/1984 | Dunn | 5/82 R |
| 4,794,656 | | 1/1989 | Henley, Jr. | 5/82 R |
| 4,928,711 | * | 5/1990 | Williams | 5/628 |
| 5,201,089 | | 4/1993 | Ferreira | 5/627 |
| 5,211,185 | * | 5/1993 | Garth et al. | 5/628 |
| 5,729,850 | | 3/1998 | Eskeli | 5/621 |
| 5,944,016 | * | 8/1999 | Ferko, III | 5/637 |

* cited by examiner

*Primary Examiner*—Michael F. Trettel
(74) *Attorney, Agent, or Firm*—Oltman, Flynn & Kubler

(57) ABSTRACT

A head stabilizer for a patient support backboard comprising a pair of slotted retainers extending laterally across the top of the backboard, and a pair of hinged head restraint units with projections for reception in the retainer slots to selectively position these units apart from each other laterally of the backboard. The head restraint units are removable for cleaning and may be folded up for storage on the backboard between the retainers.

4 Claims, 1 Drawing Sheet

BACKBOARD HEAD STABILIZER

BACKGROUND OF THE INVENTION

1. Field of the Invention

This invention relates to a novel and advantageous arrangement for stabilizing the head and neck of a patient, usually an injured person, placed on a backboard.

2. Prior Art

Various patient support backboards, both upper body boards and full body stretchers, have been proposed heretofore in which straps stabilize the patient's body by holding it against the backboard. In U.S. Pat. No. 4,794,656, head straps on the backboard are supplemented by laterally adjustable head restraints which engage the patient's head on opposite sides.

SUMMARY OF THE INVENTION

The present invention is directed to a novel head stabilizer for a patient support backboard which has laterally adjustable head restraint units for engaging the opposite sides of a patient's head, each such unit being collapsible from an operative, erected position to an inoperative, folded-down, storage position on the backboard.

A principal object of this invention is to provide a novel and advantageous head stabilizer for a patient support backboard.

Another object of this invention is to provide such a head stabilizer which is adjustable to fit various sized heads, from that of an infant to that of a grown person, even one wearing a football or hockey helmet or a biker's or motorcyclist's helmet, and is collapsible for storage in an inoperative position on the backboard itself.

Another object of the invention is to provide such a head stabilizer which is readily removable from the backboard for cleaning, after which it may be reattached to the backboard for use again.

Further objects and advantages of this invention will be apparent from the following detailed description of a presently preferred embodiment thereof shown in the accompanying drawings.

DETAILED DESCRIPTION OF THE INVENTION

Before explaining the present invention in detail it is to be understood that the invention is not limited in its application to the particular arrangement shown and described since the invention is capable of other embodiments. Also, the terminology used herein is for the purpose of description and not of limitation.

Figure 1:
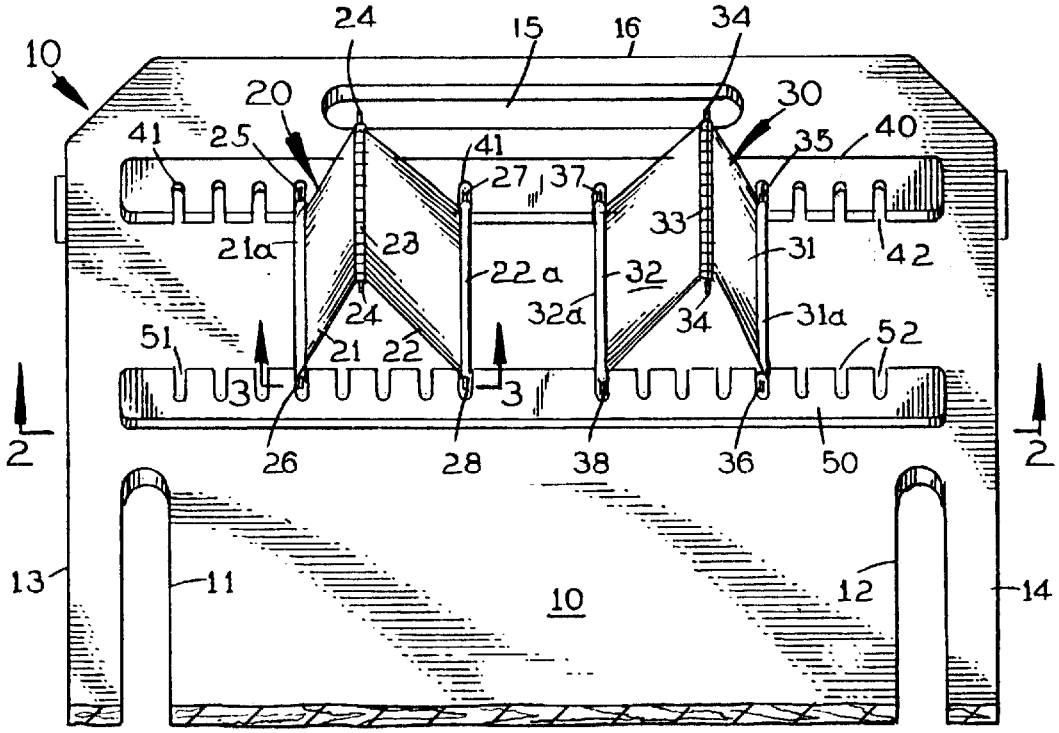
FIG. 1 is a top perspective view of the upper part of a backboard provided with a head stabilizer in accordance with the present invention.

Referring first to FIG. 1, the backboard 10 is of conventional design and may be of wood, metal or suitable substantially rigid plastic construction. The backboard has longitudinally elongated hand-hold openings 11 and 12 near its opposite side edges 13 and 14, and a laterally elongated opening 15 near its top edge 16. The length of the backboard may be just enough to accommodate an adult person's back and head, or it may be part of a stretcher that is long enough to support the full length of an adult lying prone.

In accordance with the present invention, a novel head stabilizer is provided on backboard 10 a short distance down from the hand-hold opening 15 near its top edge. This stabilizer comprises a pair of laterally adjustably positioned head restraint units 20 and 30, each of which is collapsible from the erected, operative position, shown in FIGS. 1 and 2, to a collapsed, recessed, folded-down position, shown in FIG. 4 for the left-hand stabilizer unit 20.

The left-hand head restraint unit 20 comprises a pair of thin, flat, rectangular, substantially rigid plates 21 and 22, which may be of suitable metal, plastic or wood. These plates are pivotally connected to one another along adjoining edges by a hinge 23 having a hinge pin 24 that projects a substantial distance beyond both plates 21 and 22 at the opposite end edge of each (i.e., the end edge toward the top edge 16 of the backboard, and the end edge hinge away from the top edge of the backboard).

Along its edge away from the hinge 23, plate 21 has a reinforcing segment 21*a* to which outwardly projecting pins 25 and 26 are rigidly joined at its opposite ends. Pin 25 projects toward the top edge 16 of the backboard, and pin 26 projects away from it.

Similarly, along its opposite edge from hinge 23, the other plate 22 of head restraint unit 20 has a reinforcing segment 22*a* to which outwardly projecting pins 27 and 28 are rigidly joined at its opposite ends. Pin 27 projects toward the top edge 16 of backboard 10, and pin 28 projects away from it.

As is clear from FIG. 1, the hinge pin 24 and pins 25, 26, 27 and 28 all extend lengthwise of the backboard.

The right-hand head restraint unit 30 is a mirror image of unit 20. Elements of unit 30 which correspond to those of unit 20 are given the same reference numerals, plus 10, as those of unit 20. These corresponding elements need not be described again in detail.

The left-hand head restraint unit 20 and the right-hand unit 30 are adjustably positioned in slotted retainer rails 40 and 50, which are affixed to the backboard respectively just above and below the head restraint units, as shown in FIG. 1.

At the left side of the longitudinal centerline of the backboard, retainer rail 40 presents a plurality of open-topped slots or recesses 41, each of which is open at its end next to head restraint unit 20. Each slot 41 can receive one of the projecting pins 25 and 27 of head unit 20 with a manually insertable and releasable snug fit, such as a snap-in fit. The several recesses 41 are spaced apart in succession laterally of the backboard 10 (and longitudinally of the retainer rail 40) so that the lateral position of head restraint unit 20 on the backboard can be selectively adjusted. Retainer rail 40 also is formed with a similar series of slots or recesses 42 at the right side of the longitudinal centerline of the backboard for receiving the protruding pins 35 and 37 of head restraint unit 30 with a manually insertable and removable close fit. With this arrangement, head unit 30 also can be adjustably positioned laterally of the headboard.

The opposite retainer rail 50 has a plurality of similar slots 51 on the left side of the longitudinal centerline of the backboard for holding the projecting pins 26 and 28 on head restraint unit 20. Each slot 51 in retainer rail 50 is aligned laterally of the backboard with a corresponding slot 41 in retainer rail 40. Each slot 51 is open-topped and is open at its end next to head unit 20. Retainer rail 50 also has a plurality of open-topped, open-end recesses 52 at the right side of the backboard's longitudinal centerline for holding the projecting pins 36 and 38 of head restraint unit 30. Slots 52 in rail 50 are aligned laterally of the headboard with corresponding slots 42 in retainer rail 40.

With this arrangement, the head restraint units 20 and 30 can be selectively positioned at any of several positions laterally of the patient support backboard to accommodate the particular head of any patient.

Figure 3:
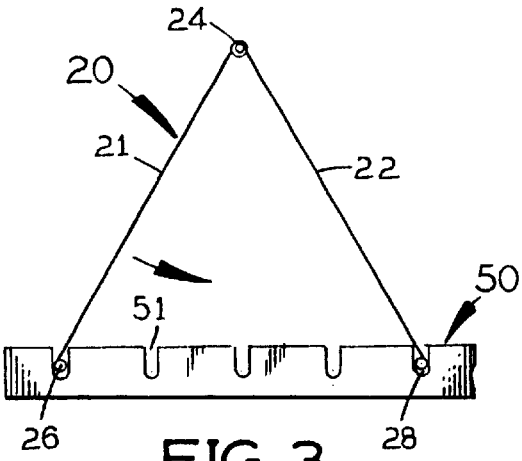
FIG. 3 is a simplified elevation of the left-hand unit of the stabilizer, taken along the line 3—3 in FIG. 1.
Figure 4:
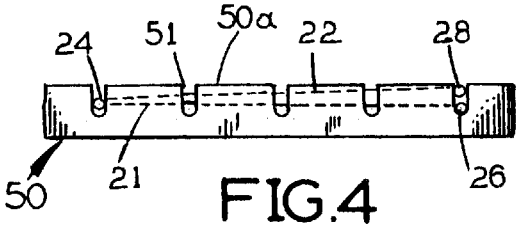
FIG. 4 is a view similar to FIG. 3 but with this stabilizer unit collapsed to a foldeddown storage position on the backboard.

When the head restraints are not to be used they may be folded down from the erected position, as shown for unit 20 in FIG. 3, to the collapsed position shown in FIG. 4. To fold down the head restraint unit 20, it is lifted up from the backboard to remove its pins 26 and 28 from the slots 51 in retainer rail 50 in which they are seated and to remove its pins 25 and 27 from the slots 41 in retainer rail 40 in which they are seated. Then, plates 21 and 22 of this head restraint are folded together, as indicated by the arrow in FIG. 3.

After being cleaned, the head restraint units may be stored in place on the patient support backboard itself so as to be readily available for use on the next patient. One end of the hinge pin 24 is placed in one of the slots 51 in retainer rail 50, as shown in FIG. 4, and the opposite end of this hinge pin is placed in the directly oppositely positioned slot 41 in retainer rail 40. The projecting pins 26 and 28 of on plates 21 and 22, respectively, are placed in another of the slots 51 in retainer rail 50, and the projecting pins 25 and 27 on these plates are placed in the corresponding slot 41 in retainer rail 40.

As shown in FIG. 4, the now-overlapped plates 21 and 22 of the folded-down head restraint unit 20 are disposed completely below the top face 50*a* of retainer rail 50 (as well as below the top face of retainer rail 40). However, it is to be understood that the folded-down head restraint unit 20 may be flush with the top faces of the retainer rails 40 and 50, or they may project slightly above.

The other head restraint unit 30 may be folded down to a stored position in the same manner.

Figure 2:
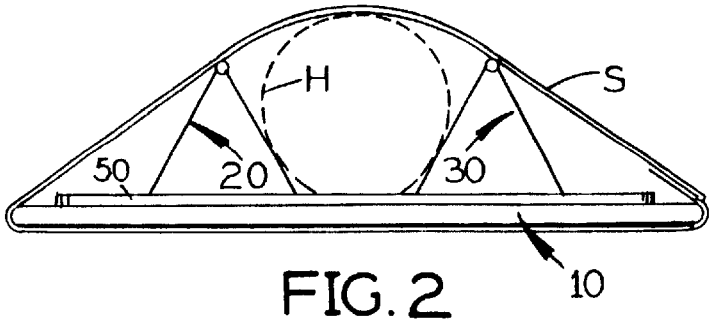
FIG. 2 is a cross-section taken along the line 2—2 in FIG. 1 just below the head stabilizer on the backboard and showing a patient's head in phantom.

As shown in FIG. 2, a hold-down strap S for the patient's head H may be provided on the backboard to extend across the top of the head. This strap is shown as extending across the bottom of the backboard and up across its opposite side edges and across the head restraints 20 and 30. Opposite ends of the strap are manually releasably attached to each other in any suitable manner, such as by "Velcro" fasteners or by a buckle. However, it is to be understood that various other arrangements of the head strap differing from the one shown may be provided which are compatible with the head stabilizer of this invention.

It is to be understood that the present head stabilizer may be an add-on to an existing patient support backboard or it may be an original part of the backboard, in which case the top of the retainer rails of the stabilizer may be flush with the remainder of the top surface of the backboard, if desired.

I claim:

1. A head stabilizer for a patient support backboard comprising a pair of head restraint units, and means for adjustably positioning said head restraint units laterally of the backboard to accommodate different sized heads, each of said head restraint units being collapsible to an inoperative storage position on the backboard, each of said head restraint units comprising a pair of hingedly connected plates having an operative position projecting up from the backboard and foldable together to an inoperative position on the backboard, and said means for adjustably positioning said head restraint units comprising retainers on the backboard which present a series of slots spaced apart laterally of the backboard, and projections on said plates removably seated in said slots.

2. A head stabilizer according to claim 1, wherein each of said head restraint units is detachable from the backboard for cleaning.

3. A head stabilizer according to claim 2, wherein said retainers are located on opposite sides of said head restraint units in a direction longitudinally of the headboard, and each of said slots is open-topped at its end toward said head restraint units.

4. A head stabilizer according to claim 3, wherein each of said projections is a pin extending from the corresponding plate for manually insertable and removable snug reception in a selected slot.

* * * * *